US010522309B2

(12) United States Patent
Brasseur et al.

(10) Patent No.: US 10,522,309 B2
(45) Date of Patent: Dec. 31, 2019

(54) SWITCHING ELEMENT FOR A CONTROL DEVICE

(71) Applicant: ELECTROLUX APPLIANCES AKTIEBOLAG, Stockholm (SE)

(72) Inventors: Jérôme Brasseur, Stockholm (SE); Alexandre Barros Neves, Stockholm (SE); Eddie Cheng, Stockholm (SE); Jürgen Feser, Rothenberg ob der Tauber (DE); Klaus Winkelmann, Rothenberg ob der Tauber (DE)

(73) Assignee: Electrolux Appliances Aktiebolag, Stockholm (SE)

( * ) Notice: Subject to any disclaimer, the term of this patent is extended or adjusted under 35 U.S.C. 154(b) by 0 days.

(21) Appl. No.: 16/098,005

(22) PCT Filed: Apr. 18, 2017

(86) PCT No.: PCT/EP2017/059139
§ 371 (c)(1),
(2) Date: Oct. 31, 2018

(87) PCT Pub. No.: WO2017/190942
PCT Pub. Date: Nov. 9, 2017

(65) Prior Publication Data

US 2019/0148092 A1 May 16, 2019

(30) Foreign Application Priority Data

May 3, 2016 (EP) ..... 6168177
Aug. 17, 2016 (EP) ..... 6184563

(51) Int. Cl.
*H01H 25/06* (2006.01)
*H01H 15/10* (2006.01)
(Continued)

(52) U.S. Cl.
CPC ..... *H01H 25/065* (2013.01); *H01H 15/10* (2013.01); *H01H 25/06* (2013.01);
(Continued)

(58) Field of Classification Search
CPC ..... H01H 25/06; H01H 25/065; H01H 2003/0293; H01H 2019/006;
(Continued)

(56) References Cited

U.S. PATENT DOCUMENTS 8,884,933 B2 * 11/2014 Yokoyama ..... G06F 3/03547 345/184
9,620,312 B2 * 4/2017 Ely ..... H01H 3/122
(Continued)

FOREIGN PATENT DOCUMENTS

DE 60305276 T2 5/2007
EP 1995753 A1 11/2008
WO 2012136571 A1 10/2012

OTHER PUBLICATIONS

International Search Report and Written Opinion issued in PCT Application No. PCT/EP2017/059139 dated May 30, 2017, 10 pages.

*Primary Examiner* — Felix O Figueroa
(74) *Attorney, Agent, or Firm* — Pearne & Gordon LLP

(57) ABSTRACT

The present invention relates to a switching element (10) for a control device, in particular of a domestic appliance. The switching element (10) comprises a rotatable and shiftable rim element (14) being rotatable around and shiftable along the same axis. The switching element (10) comprises a stator element (20). The rim element (14) is rotatably and shiftably coupled to the stator element (20). The switching element (10) comprises a micro switch (16) including a stationary part and a movable part (30). The stationary part of the micro switch (16) is coupled to the stator element (20), while the movable part (30) of the micro switch (16) is rotatable
(Continued)

Figure 1:
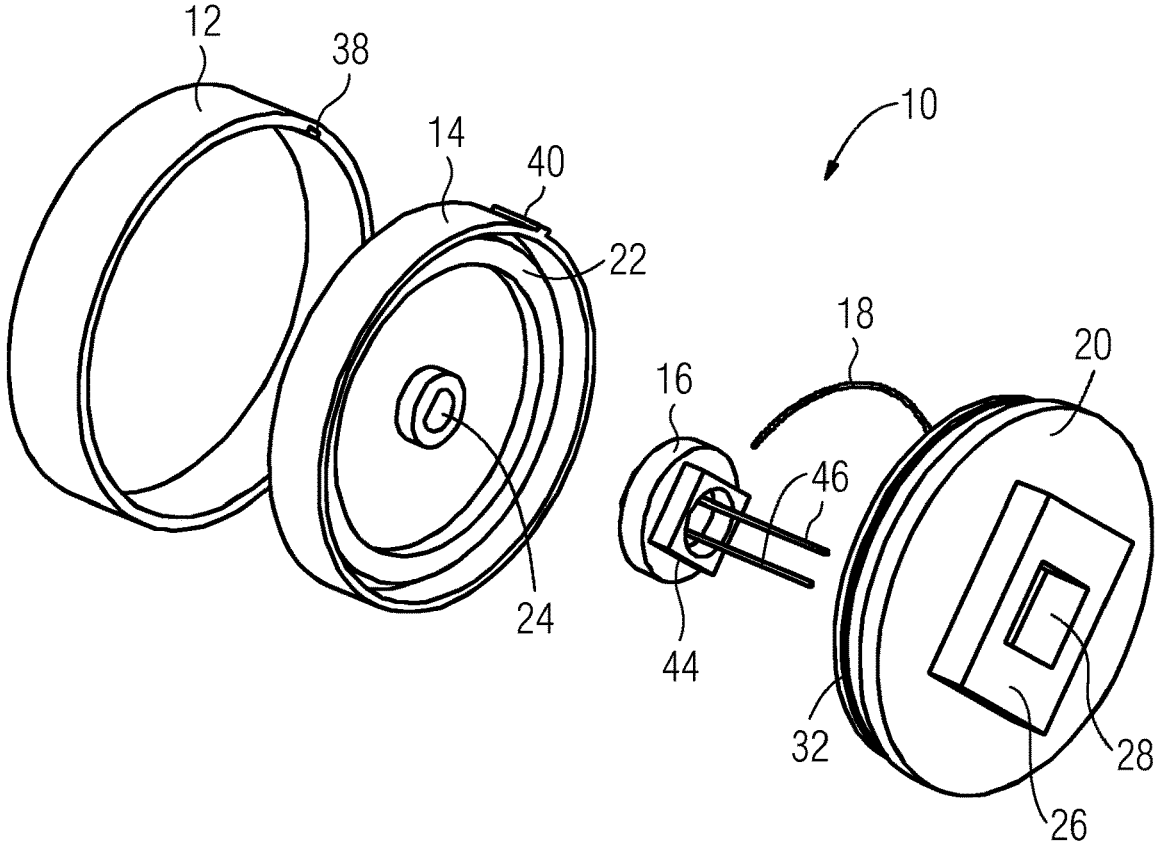

around and shiftable along the same axis and coupled to the rim element (14). The micro switch (16) includes an encoder for indicating a rotation left or right and a shifting of the movable part (30) of said micro switch (16). The switching element (10) comprises at least one sensor antenna (18) forming a part of a capacitive touch sensor.

15 Claims, 4 Drawing Sheets

(51) Int. Cl.
*H01H 3/02* (2006.01)
*H01H 19/00* (2006.01)

(52) U.S. Cl.
CPC ..... *H01H 2003/0293* (2013.01); *H01H 2019/006* (2013.01); *H01H 2239/006* (2013.01); *H01H 2300/008* (2013.01)

(58) Field of Classification Search
CPC ..... H01H 2239/006; G06F 3/044; H03K 17/962; H03K 17/975; H03K 2217/9607
See application file for complete search history.

(56) References Cited

U.S. PATENT DOCUMENTS

| | | | | |
|---|---|---|---|---|
| 9,734,968 | B2 * | 8/2017 | Kobayashi | H01H 25/06 |
| 2018/0029502 | A1 * | 2/2018 | Georgiev | B60N 2/0228 |

* cited by examiner

SWITCHING ELEMENT FOR A CONTROL DEVICE

The present invention relates to a switching element for a control device, in particular of a domestic appliance. Further, the present invention relates to a control device, in particular for a domestic appliance. Moreover, the present invention relates to a domestic appliance including at least one control device.

A control device, in particular of a domestic appliance, requires one or more switching elements in order to control the domestic appliance. Usually, an on-off switch or push button is provided for activating and deactivating a component or an operation mode, while a knob control or slide control is provided for adjusting an operation parameter.

EP 1 995 753 A1 discloses a switching element for a control device of a domestic appliance. The switching element comprises a central push button and a peripheral disc or control ring. An operation parameter of the domestic appliance may be adjusted by rotating the peripheral disc or control ring around its rotational symmetry axis. The operation parameter of the domestic appliance may be switched by pressing the central push button.

However, the switching element according to EP 1 995 753 A1 allows the user to communicate with the control device only by two steps. In a first step, the user moves by rotating the peripheral disc between settings proposed as a fixed catalogue by the control device. In a second step, the user selects and sets one or more of said settings by pushing the push button. It is difficult for a novel user to communicate with the control device in further enhanced ways.

It is an object of the present invention to provide a switching element for a control device, which overcomes the problems mentioned above.

According to the present invention a switching element for a control device, in particular of a domestic appliance, is provided, wherein

- the switching element comprises a rotatable and shiftable rim element,
- said rim element is rotatable around and shiftable along the same axis,
- the switching element comprises a stator element,
- the rim element is rotatably and shiftably coupled to the stator element,
- the switching element comprises a micro switch including a stationary part and a movable part,
- the stationary part of the micro switch is coupled to the stator element,
- the movable part of the micro switch is rotatable around and shiftable along the same axis and coupled to the rim element,
- the micro switch includes an encoder for indicating a rotation left or right and a shifting of the movable part of said micro switch, and
- the switching element comprises at least one sensor antenna forming a part of a capacitive touch sensor.

The switching element according to the present invention comprises a rotatable push button including the touch sensor. The sensor antenna is one part of said touch sensor. The sensor antenna detects the hand of a user, if said hand is close to the rotatable push button or is already grabbing it. The sensor antenna issues an electric or electronic signal, which can be delivered to the control device in order to communicate in advance to the control device that the user is going to interact with the switching element. The user may select or set a parameter of the control device via the rotatable push button. In this way, an alert mode of the control device may be triggered in advance before any parameter is selected or set by the user via the rotatable push button.

For example, the sensor antenna is formed as a ring segment. The sensor antenna is at least partially made of metal.

Preferably, the stator element includes a peripheral groove for receiving the sensor antenna.

Further, the rim element may include a seat element for receiving at least partially the movable part of the micro switch, so that relative rotation and shift between the seat element and said movable part is avoided.

In particular, the movable part of the micro switch is a shaft rotatable around and shiftable along a longitudinal axis of said shaft.

Preferably, the stator element includes a stator protrusion extending rearwards, wherein preferably said stator protrusion is ashlar-formed.

Moreover, the stator element may include a cut-out formed in the stator protrusion of said stator element, wherein preferably electrical leads of or from the micro switch penetrate said cut-out.

According to a preferred embodiment of the present invention the switching element comprises a cover element encasing partially the rim element, wherein preferably the cover element encases a front side and a circumferential side of said rim element. The cover element defines the design of the switching element. Thus, different designs for the switching element are possible by providing the corresponding cover elements.

In particular, the cover element includes at least one nut, while the rim element includes at least one tongue corresponding with said nut, so that a torque proof connection is formed between the cover element and the rim element.

For example, the cover element is at least partially made of metal. The metal cover element may form a part of the capacitive touch sensor.

Preferably, the rim element includes at least one first latch element, while the stator element includes at least one second latch element corresponding with said first latch element, so that the rim element is rotatably and shiftably coupled to the stator element.

Further, the present invention relates to a control device, in particular for a domestic appliance, wherein the control device includes at least one switching element mentioned above.

Preferably, the control device comprises at least one panel for receiving at least one switching element.

Further, the panel may include at least one cut-out for receiving the switching element, wherein preferably said cut-out receives the stator protrusion of the stator element. In particular, the cut-out and the stator protrusion have the same or a similar cross-section, wherein the cross-section of the cut-out is marginally bigger than the cross-section of the stator protrusion.

At last, the present invention relates to a domestic appliance including at least one control device, wherein the domestic appliance includes at least one switching element and/or at least one control device mentioned above.

Novel and inventive features of the present invention are set forth in the appended claims.

Figure 2:
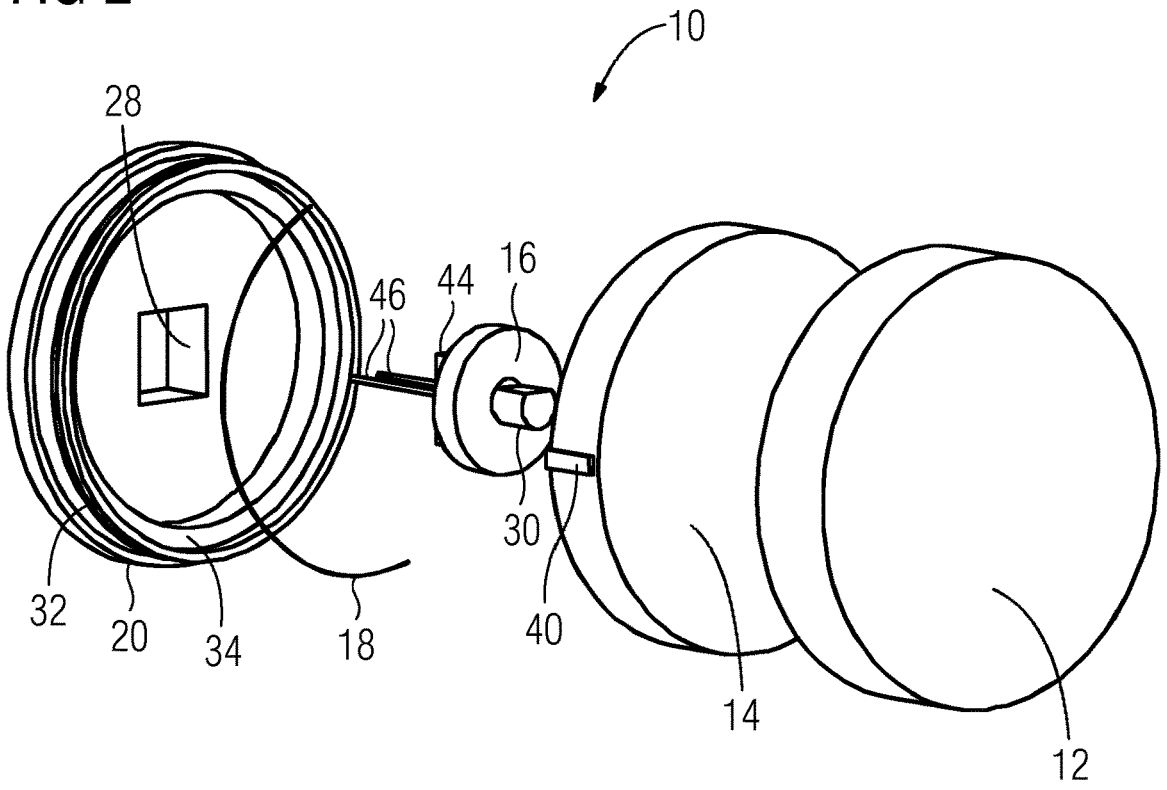
Figure 3:
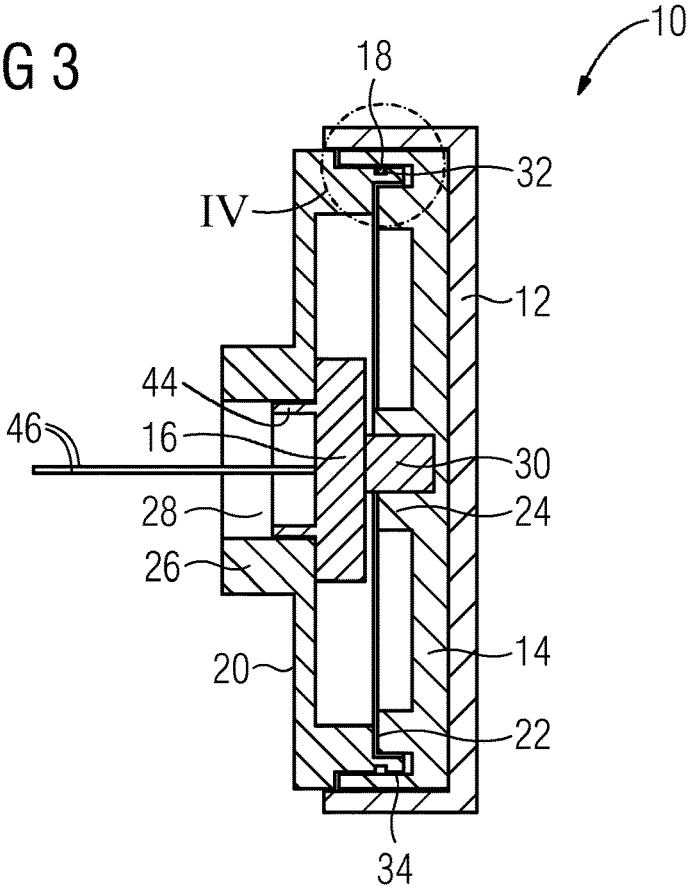
Figure 4:
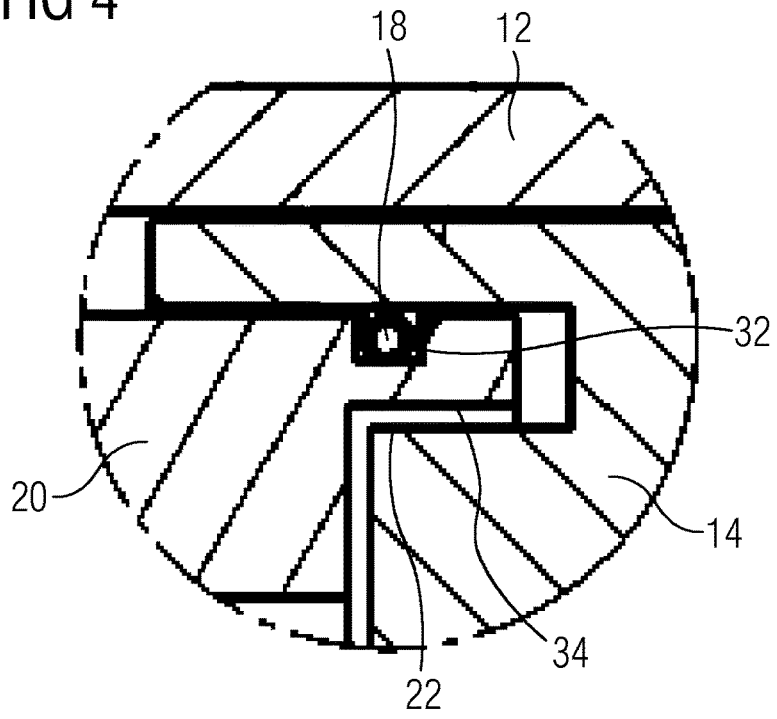
Figure 5:
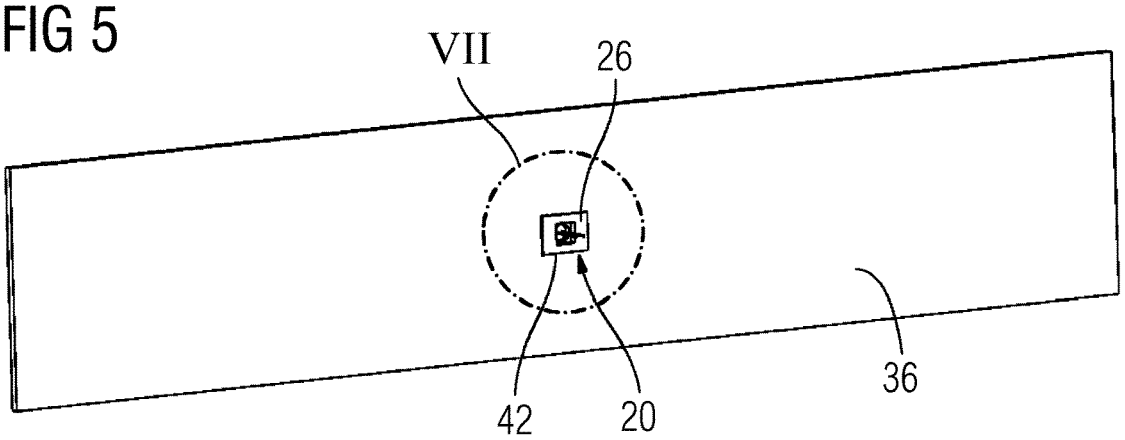
Figure 6:
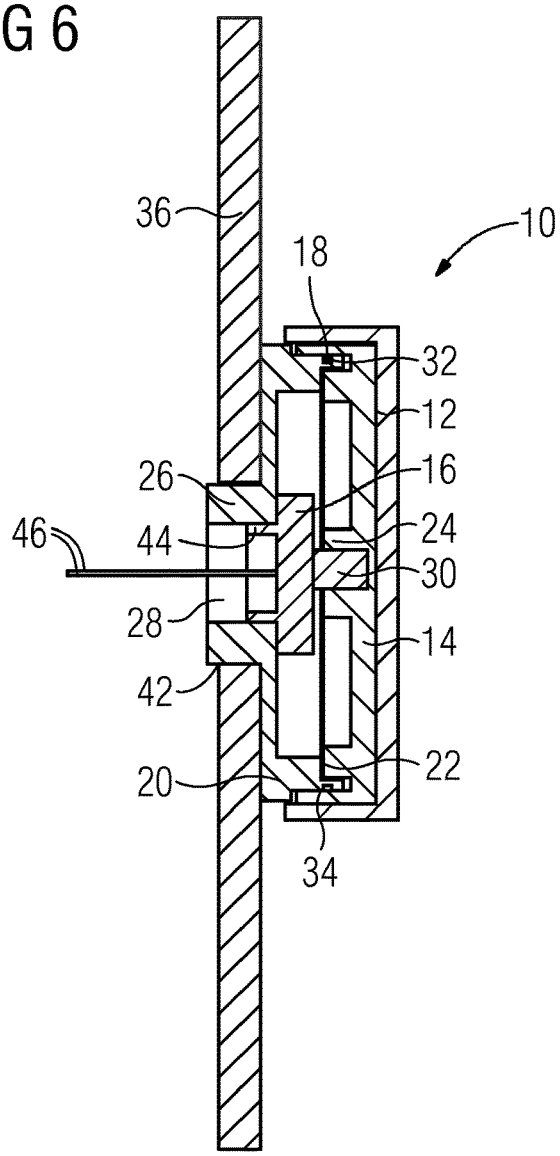
Figure 7:
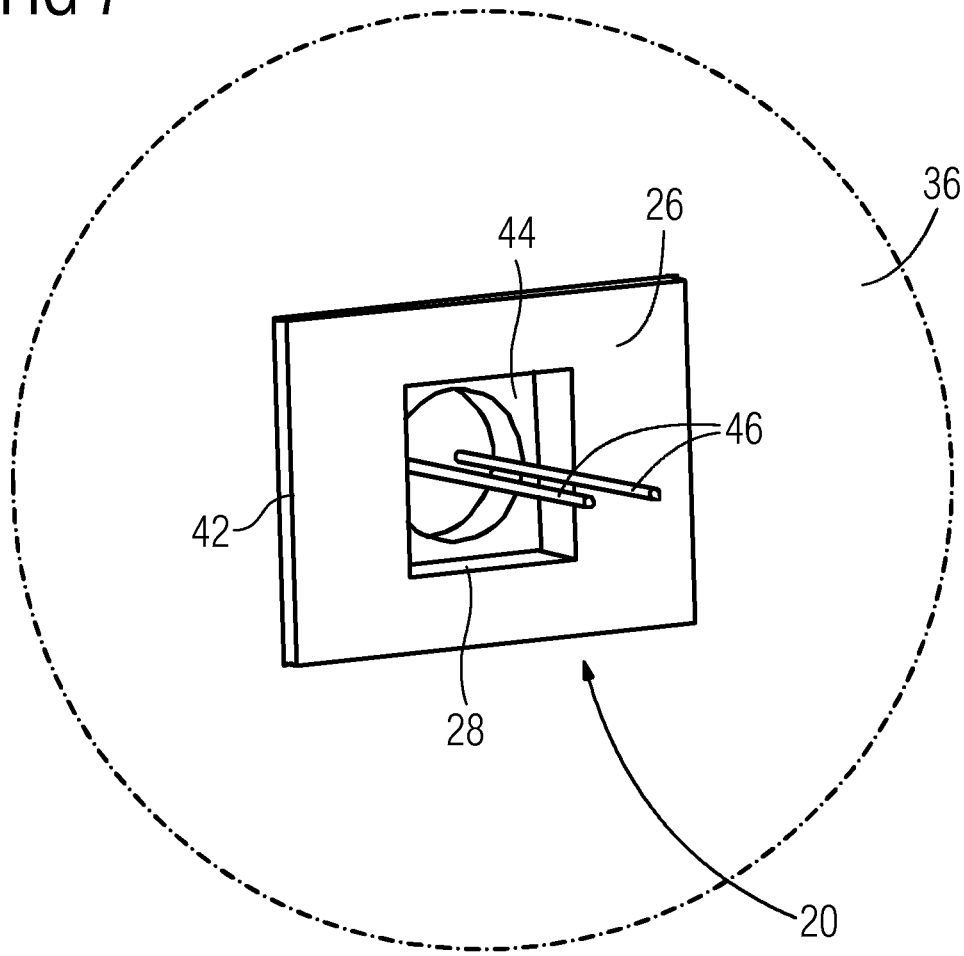

The present invention will be described in further detail with reference to the drawing, in which FIG. 1 illustrates a schematic exploded perspective rear view of a switching element according to a preferred embodiment of the present invention, FIG. 2 illustrates a schematic exploded perspective front view of the switching element according to the preferred embodiment of the present invention, FIG. 3 illustrates a schematic sectional side view of the switching element according to the preferred embodiment of the present invention, FIG. 4 illustrates a schematic detailed sectional view of a peripheral portion of the switching element according to the preferred embodiment of the present invention, FIG. 5 illustrates a schematic perspective rear view of a panel with the switching element according to the preferred embodiment of the present invention, FIG. 6 illustrates a schematic sectional side view of the panel with the switching element according to the preferred embodiment of the present invention, and FIG. 7 illustrates a schematic detailed perspective rear view of the panel with the switching element according to the preferred embodiment of the present invention.

FIG. 1 illustrates a schematic exploded perspective rear view of the switching element 10 according to a preferred embodiment of the present invention. The switching element 10 is provided for a control device, in particular for a control device of a domestic appliance.

The switching element 10 comprises a cover element 12, a rim element 14, a micro switch 16, a sensor antenna 18 and a stator element 20. The cover element 12, the rim element 14, the micro switch 16 and the stator element 20 are substantially formed rotation-symmetric. The cover element 12, the rim element 14, the micro switch 16 and the stator element 20 are arranged in such a way that their rotation-symmetry axes coincide.

The cover element 12 includes a circular disc and a cylinder barrel. The circular disc is arranged at the front side, while the cylinder barrel extends rearwards from said circular disc. The terms "front" and "front side" relate to that side facing the user. In contrast, the terms "rear", "rear side" and "behind" relate to that side averted from the user. At least one nut 38 is formed at the inner side of the cylinder barrel of the cover element 12. The nut 38 extends parallel to the rotation-symmetry axis of the cover element 12.

In this example, the cover element 12 is formed as a single-piece part and has the shape of a cap.

The cover element 12 receives the rim element 14. The inner diameter of the cylinder barrel of the cover element 12 is marginally bigger than the outer diameter of the rim element 14. The circular disc of the cover element 12 is arranged in front of the rim element 14, while the cylinder barrel of the cover element 12 encloses an outer circumferential side of the rim element 14. At least one tongue 40 is formed at the outer circumferential side of the rim element 14. The nut 38 of the cover element 12 and the tongue 40 of the rim element 14 are complementary to each other. The nut 38 and the tongue 40 guarantee that the cover element 12 and the rim element 14 are rotated synchronously. Factually, the cover element 12 and the rim element 14 form a rigid body.

The rim element 14 includes a first latch element 22 formed as an annular protrusion. The first latch element 22 is arranged in the outer portion of the rim element 14 and extends rearwards from said rim element 14. Further, the rim element 14 includes a seat element 24. Said seat element 24 is formed cylinder barrel and extends rearwards from the rim element 14. The seat element 24 is arranged in the outer portion of the rim element 14. A recess enclosed by the seat element 24 has a special non-rotation-symmetric shape.

The stator element 20 is arranged behind the rim element 24. The micro switch 16 is arranged between the rim element 24 and the stator element 20. The stator element 20 includes a peripheral groove 32 formed at the circumferential side of said stator element 20. The peripheral groove 32 receives the sensor antenna 18. The sensor antenna 18 is formed as a ring segment. A stator protrusion 26 is formed at the inner side of the stator element 20. In this example, the stator protrusion 26 is ashlar-formed. Further, a first cut-out 28 is formed within said stator protrusion 26 of the stator element 20. In this example, the first cut-out 28 is rectangular.

The micro switch 16 includes a switch protrusion 44. The switch protrusion 44 is arranged at the rear side of said micro switch 16. The switch protrusion 44 of the micro switch 16 is received by the first cut-out 28 formed within the stator protrusion 26 of the stator element 20. The switch protrusion 44 of the micro switch 16 has substantially the same shape as the first cut-out 28 in the stator protrusion 26 of the stator element 20. The switch protrusion 44 of the micro switch 16 is marginally smaller than the first cut-out 28 in the stator protrusion 26 of the stator element 20.

Further, the micro switch 16 includes electric leads 46. Said electric leads 46 extend from the micro switch 16 to the control device and/or to the interior of the domestic appliance. The electric leads 46 penetrate the first cut-out 28 in the stator protrusion 26 of the stator element 20.

FIG. 2 illustrates a schematic exploded perspective front view of the switching element 10 according to the preferred embodiment of the present invention.

The cover element 12 receives the rim element 14. The peripheral groove 32 of the stator element 20 receives the sensor antenna 18. The micro switch 16 is arranged between the rim element 24 and the stator element 20.

The micro switch 16 includes a shaft 30 arranged at the front side of said micro switch 16. The longitudinal axis of the shaft 30 extends along the common its rotation-symmetry axis of the rim element 14 and micro switch 16. The shaft 30 is rotatable around its longitudinal axis. Additionally, the shaft 30 is shiftable along its longitudinal axis. The shaft 30 is received by the seat element 24 of the rim element 14. Thus, the shaft 30 is rotatable and shiftable by rotating and pushing, respectively, the cover element 12 and rim element 14. The recess enclosed by the seat element 24 of the rim element 14 and the shaft 30 of the micro switch 16 have the same or a similar cross-section, wherein the cross-section of said recess is marginally bigger than the cross-section of the shaft 30. The recess and the shaft 30 have such shapes that relative rotation and motion between the recess and the shaft 30 is avoided.

In this example, the recess of the seat element 24 as well as the shaft 30 has a semi-circular cross-section. Said semi-circular cross-sections of the recess of the seat element 24 and of the shaft 30 allow a lock against rotation of the rim element 14 relative to the shaft 16. In general, the cross-sections of the recess of the seat element 24 and of the shaft 30 are asymmetric with respect to the rotation around the longitudinal axis of the shaft 30.

The shaft 30 and the switch protrusion 44 are arranged at opposite sides of the micro switch 16. The shaft 30 is arranged at the front side of the micro switch 16, while the switch protrusion 44 is arranged at the rear side of said micro switch 16.

The electric leads 46 of the micro switch 16 penetrate the first cut-out 28 in the stator protrusion 26 of the stator element 20.

The stator element 20 includes a second latch element 34. The second latch element 34 of the stator element 20 engages with the first latch element 22 of the rim element 14, so that the rim element 14 is rotatable relative to the stator element 20 around their common rotation-symmetry axis. The first latch element 22 and the second latch element 34 provide the mechanical connection between the rim element 14 and the stator element 20.

FIG. 3 illustrates a schematic sectional side view of the switching element 10 according to the preferred embodiment of the present invention.

The rim element 14 is received by the cover element 12, so that the cover element 12 and the rim element 14 form the rigid body. Further, the rim element 14 is rotatable at the stator element 20 via the first latch element 22 and the second latch element 34. The micro switch 16 is arranged between the rim element 24 and the stator element 20. The shaft 30 of the micro switch 16 is received by the seat element 24 of the rim element 14. The sensor antenna 18 is received by the peripheral groove 32 of the stator element 20. The sensor antenna 18 forms a part of a capacitive touch sensor.

The shaft 30 of the micro switch 16 is arranged at the front side of said micro switch 16, while the switch protrusion 44 is arranged at the rear side of said micro switch 16. The shaft 30 is rotatable around its longitudinal axis relative to the micro switch 16. Further, the shaft 30 is shiftable along its longitudinal axis relative to the micro switch 16. The electric leads 46 of the micro switch 16 penetrate the first cut-out 28 in the stator protrusion 26 of the stator element 20.

FIG. 4 illustrates a schematic detailed sectional view of a peripheral portion of the switching element 10 according to the preferred embodiment of the present invention.

The sensor antenna 18 is received by the peripheral groove 32 of the stator element 20. The first latch element 22 of the rim element 14 engages with the second latch element 34 of the stator element 20, so that the rim element 14 and the cover element 12 are rotatable relative to the stator element 20 around their common rotation-symmetry axis.

FIG. 5 illustrates a schematic perspective rear view of a panel 36 with the switching element 10 according to the preferred embodiment of the present invention. The panel 36 is a part of the control device.

The panel 36 includes a second cut-out 42 for receiving the switching element 10. In this example, the second cut-out 42 is marginally bigger than the cross-section of the stator protrusion 26 of the stator element 20. The stator protrusion 26 of the stator element 20 penetrates the second cut-out 42 of the panel 36. The stator element 20 is a stationary part of the control device.

FIG. 6 illustrates a schematic sectional side view of the panel 36 with the switching element 10 according to the preferred embodiment of the present invention.

The cover element 12 substantially covers the whole switching element. The protrusion 26 of the stator element 20 penetrates the second cut-out 42 of the panel 36. The stator element 20 is arranged stationary at the panel 36. The rim element 14 is rotatable at the stator element 20 via the first latch element 22 and the second latch element 34. The micro switch 16 is arranged between the rim element 24 and the stator element 20. The shaft 30 of the micro switch 16 is received by the seat element 24 of the rim element 14. The shaft 30 of the micro switch 16 is rotatable by rotating the rim element 24 and the cover element 12.

Moreover, the shaft 30 of the micro switch 16 is shiftable by pushing the rim element 24 and the cover element 12. The sensor antenna 18 is received by the peripheral groove 32 of the stator element 20. The first cut-out 28 in the protrusion 26 allows that the electrical leads 46 of or from the micro switch 30 pass through said first cut-out 28 into the interior of the control device or domestic appliance.

The switch protrusion 44 is arranged at the rear side of the micro switch 16, while the shaft 30 of the micro switch 16 is arranged at the front side of said micro switch 16. The shaft 30 is rotatable around its longitudinal axis relative to the micro switch 16. Moreover, the shaft 30 is shiftable along its longitudinal axis relative to the micro switch 16. Furthermore, the electric leads 46 of the micro switch 16 penetrate the first cut-out 28 in the stator protrusion 26 of the stator element 20.

FIG. 7 illustrates a schematic detailed perspective rear view of the panel 36 with the switching element 10 according to the preferred embodiment of the present invention.

The stator protrusion 26 of the stator element 20 penetrates the second cut-out 42 of the panel 36. The stator element 20 with the stator protrusion 26 and the body of micro switch 16 form the stationary part of the control device, wherein the cover element 12, the rim element 14, the sensor antenna 18 and the shaft 30 of the micro switch 16 form the movable part of the control device.

The micro switch 16 allows two different functions. The shaft 30 of the micro switch 16 may be shifted along its longitudinal axis by pushing the rim element 14 and may be rotated around its longitudinal axis by rotating said rim element 14. The micro switch 16 includes an encoder for indicating turning left or right of the rim element 14 and axial pushing of said rim element 14.

The switch protrusion 44 of the micro switch 16 is arranged at the rear side of said micro switch 16 and received by the first cut-out 28 in the stator protrusion 26 of the stator element 20. The electric leads 46 of the micro switch 16 penetrate the switch protrusion 44 of said micro switch 16 and the first cut-out 28 in the stator protrusion 26 of the stator element 20.

The switching element according to the present invention comprises beside the rotatable and shiftable push button additionally the sensor antenna 18. The sensor antenna 18 forms a part of the capacitive touch sensor. The sensor antenna 18 detects the hand of the user, if said hand is close to the rotatable push button or is already grabbing it. The sensor antenna 18 issues an electric or electronic signal, which can be delivered to the control device in order to communicate in advance to the control device that the user is going to interact with the switching element 10. The user may select or set a parameter of the control device via the rotatable push button. In this way, an alert mode of the control device may be triggered in advance before any parameter is selected or set by the user via the rotatable push button.

The switching element of the present invention is provided for the control device of an arbitrary electric domestic appliance. The switching element is suitable for stationary and mobile domestic appliances. For example, the inventive switching element is provided for a washing machine, a cooking oven, a coffee machine and any other domestic appliance within and without of the kitchen.

Although an illustrative embodiment of the present invention has been described herein with reference to the accompanying drawings, it is to be understood that the present invention is not limited to that precise embodiment, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 switching element
12 cover element

14 rim element
16 micro switch
18 sensor antenna
20 stator element
22 first latch element
24 seat element
26 stator protrusion
28 first cut-out
30 shaft
32 peripheral groove
34 second latch element
36 panel
38 nut
40 tongue
42 second cut-out
44 switch protrusion
46 electric lead

The invention claimed is:

1. A switching element for a control device, comprising:
a rotatable and shiftable rim element that is rotatable around and shiftable along the same axis,
a stator element rotatably and shiftably coupled to the rim element,
a micro switch including a stationary part and a movable part, the stationary part being coupled to the stator element, the movable part being coupled to the rim element and being rotatable and shiftable therewith about and along said axis,
the micro switch comprising an encoder for indicating rotation left or right and shifting of the movable part of said micro switch, and
a sensor antenna forming a part of a capacitive touch sensor, the sensor antenna being formed as a ring segment.

2. A switching element for a control device, comprising:
a rotatable and shiftable rim element that is rotatable around and shiftable along the same axis,
a stator element rotatably and shiftably coupled to the rim element, said stator element comprising a stator protrusion extending rearward and a cut-out formed in said stator protrusion,
a micro switch including a stationary part and a movable part, the stationary part being coupled to the stator element, the movable part being coupled to the rim element and being rotatable and shiftable therewith about and along said axis,
the micro switch comprising an encoder for indicating rotation left or right and shifting of the movable part of said micro switch, and
a sensor antenna forming a part of a capacitive touch sensor.

3. The switching element according to claim 1, wherein the stator element includes a peripheral groove for receiving the sensor antenna.

4. The switching element according to claim 1, wherein the rim element includes a seat element for receiving at least partially the movable part of the micro switch, so that relative rotation and shift between the seat element and said movable part is avoided.

5. The switching element according to claim 1, wherein the movable part of the micro switch is a shaft rotatable around and shiftable along a longitudinal axis of said shaft.

6. The switching element according to claim 1, wherein the rim element includes at least one first latch element, while the stator element includes at least one second latch element corresponding with said first latch element, so that the rim element is rotatably and shiftably coupled to the stator element.

7. A control device for a domestic appliance, wherein comprising the switching element according to claim 1.

8. The control device according to claim 7, wherein comprising a panel for receiving said switching element.

9. The control device according to claim 7, wherein the panel includes at least one cut-out for receiving the switching element, said cut-out receiving the stator protrusion of the stator element.

10. A domestic appliance comprising the control device of claim 7.

11. A switching element for a control device, comprising:
a rotatable and shiftable rim element that is rotatable around and shiftable along the same axis,
a cover element encasing a front side and a circumferential side of said rim element,
a stator element rotatably and shiftably coupled to the rim element,
a micro switch including a stationary part and a movable part, the stationary part being coupled to the stator element, the movable part being coupled to the rim element and being rotatable and shiftable therewith about and along said axis,
the micro switch comprising an encoder for indicating rotation left or right and shifting of the movable part of said micro switch, and
a sensor antenna forming a part of a capacitive touch sensor.

12. The switching element according to claim 11, wherein the cover element includes at least one nut, while the rim element includes at least one tongue corresponding with said nut, so that a torque proof connection is formed between the cover element and the rim element.

13. The switching element according to claim 11 wherein the cover element is at least partially made of metal.

14. The control device according to claim 1, said stator protrusion being ashlar-formed.

15. The control device according to claim 1, wherein electrical leads of or from the micro switch penetrate said cut-out.

* * * * *